US010836609B2

(12) United States Patent
Fernandez et al.

(10) Patent No.: US 10,836,609 B2
(45) Date of Patent: Nov. 17, 2020

(54) ELEVATOR CAR

(71) Applicants: Otis Elevator Company, Farmington, CT (US); Juan Jose Fernandez, Madrid (ES)

(72) Inventors: Juan Jose Fernandez, Madrid (ES); Cristina Hernandez-Martin, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 281 days.

(21) Appl. No.: 15/555,742

(22) PCT Filed: Mar. 5, 2015

(86) PCT No.: PCT/EP2015/054644
§ 371 (c)(1),
(2) Date: Sep. 5, 2017

(87) PCT Pub. No.: WO2016/138962
PCT Pub. Date: Sep. 9, 2016

(65) Prior Publication Data
US 2018/0050885 A1 Feb. 22, 2018

(51) Int. Cl.
*B66B 11/02* (2006.01)

(52) U.S. Cl.
CPC ..... *B66B 11/0233* (2013.01); *B66B 11/024* (2013.01)

(58) Field of Classification Search
CPC ..... B66B 11/0226; B66B 11/0233; B66B 11/024
See application file for complete search history.

(56) References Cited

U.S. PATENT DOCUMENTS 2,398,627 A * 4/1946 Disbro ..... B66B 11/024 454/68
3,103,708 A 9/1963 Pomeroy et al.
5,862,889 A * 1/1999 Sevilleja ..... B66B 1/466 187/395
7,625,097 B2 * 12/2009 Endo ..... B66B 11/0233 313/485
9,457,993 B2 * 10/2016 Somma ..... B66B 11/0206
(Continued)

FOREIGN PATENT DOCUMENTS

CN 1576681 A 2/2005
CN 2006303022545 11/2006
(Continued)

OTHER PUBLICATIONS

International Search Report and Written Opinion for application PCT/EP2015/054644, dated Feb. 1, 2016, 18pgs.
(Continued)

*Primary Examiner* — Minh Truong
(74) *Attorney, Agent, or Firm* — Cantor Colburn LLP

(57) ABSTRACT

An elevator car (2) comprising a passenger compartment defining an interior space (4) surrounded by sidewalls (62, 63, 64) and at least one car door; and at least one lighting arrangement (11) configured to illuminate the interior space (4). Said lighting arrangement (11) is associated with a ventilation system (18) configured to ventilate the interior space (4) even in a situation where the car door is closed.

19 Claims, 8 Drawing Sheets

(56) References Cited

U.S. PATENT DOCUMENTS

| | | | | |
|---|---|---|---|---|
| 2004/0262094 | A1* | 12/2004 | Yoon | B66B 11/0233 187/401 |
| 2005/0124282 | A1* | 6/2005 | Santos | B66B 11/024 454/68 |
| 2007/0251767 | A1* | 11/2007 | Yoon | B66B 11/0226 187/401 |
| 2014/0305749 | A1* | 10/2014 | Manner | B66B 11/0226 187/401 |

FOREIGN PATENT DOCUMENTS

| | | | |
|---|---|---|---|
| CN | 1878719 | A | 12/2006 |
| CN | 2878306 | Y | 3/2007 |
| CN | 2006303022526 | | 11/2007 |
| CN | 200930131521 | | 2/2010 |
| CN | 102070062 | A | 5/2011 |
| CN | 104276492 | A | 1/2015 |
| DE | 9311505 | U1 | 1/1994 |
| EP | 0282640 | A1 | 9/1988 |
| EP | 0788996 | A2 | 8/1997 |
| EP | 1619158 | A1 | 1/2006 |
| EP | 1950166 | A1 | 7/2008 |
| JP | D200514377 | | 6/2006 |
| JP | 2010064891 | A | 3/2010 |
| JP | 2012082044 | A | 4/2012 |
| JP | 2014097850 | A | 5/2014 |
| JP | D2014005970 | | 1/2015 |
| KR | 3020080039392 | | 6/2009 |
| KR | 3020080039395 | | 6/2009 |
| KR | 3020080039399 | | 9/2009 |
| KR | 3020120015882 | | 6/2013 |
| KR | 3020130054839 | | 7/2014 |
| WO | 2005121011 | A1 | 12/2005 |

OTHER PUBLICATIONS

Chinese First Office Action and Search Report for application CN 201580077466.4, dated Aug. 21, 2018, 15 pages.

* cited by examiner

ELEVATOR CAR

The invention is related to an elevator car, in particular to an elevator car comprising a lighting arrangement for illuminating the elevator car's interior space and a ventilation system for ventilating the interior space.

The cars of elevators which are intended for passenger transportation need to be provided with a lighting arrangement for illuminating the elevator car's interior space forming the passenger compartment and a ventilation system for ventilating said interior space in particular when the car doors are closed and neither light nor air are able to enter into the interior space from outside the elevator car.

Recent developments in the design of elevator car's have increased the demands on lighting arrangements and ventilation systems. In consequence, there is a desire for an improved elevator car design providing lighting arrangements and ventilation systems with improved characteristics, which are also easy to produce, install and maintain.

An elevator car according to an exemplary embodiment of the invention comprises a passenger compartment defining an interior space surrounded by sidewalls and at least one car door, and at least one lighting arrangement which is configured for illuminating the interior space. Said lighting arrangement is associated with a ventilation system being configured for ventilating the interior space even in a situation in which all car doors are closed.

Associating the lighting arrangement with a ventilation system allows an improved design of the elevator car providing enhanced ventilating and illuminating capabilities as well as more space for the passengers and/or load to be transported by the elevator without increasing the outer dimensions of the elevator car.

Exemplary embodiments of the inventions are described in the following in more detail with reference to the enclosed figures.

SHORT DESCRIPTION OF THE FIGURES

DETAILED DESCRIPTION OF THE FIGURES

Figure 1:
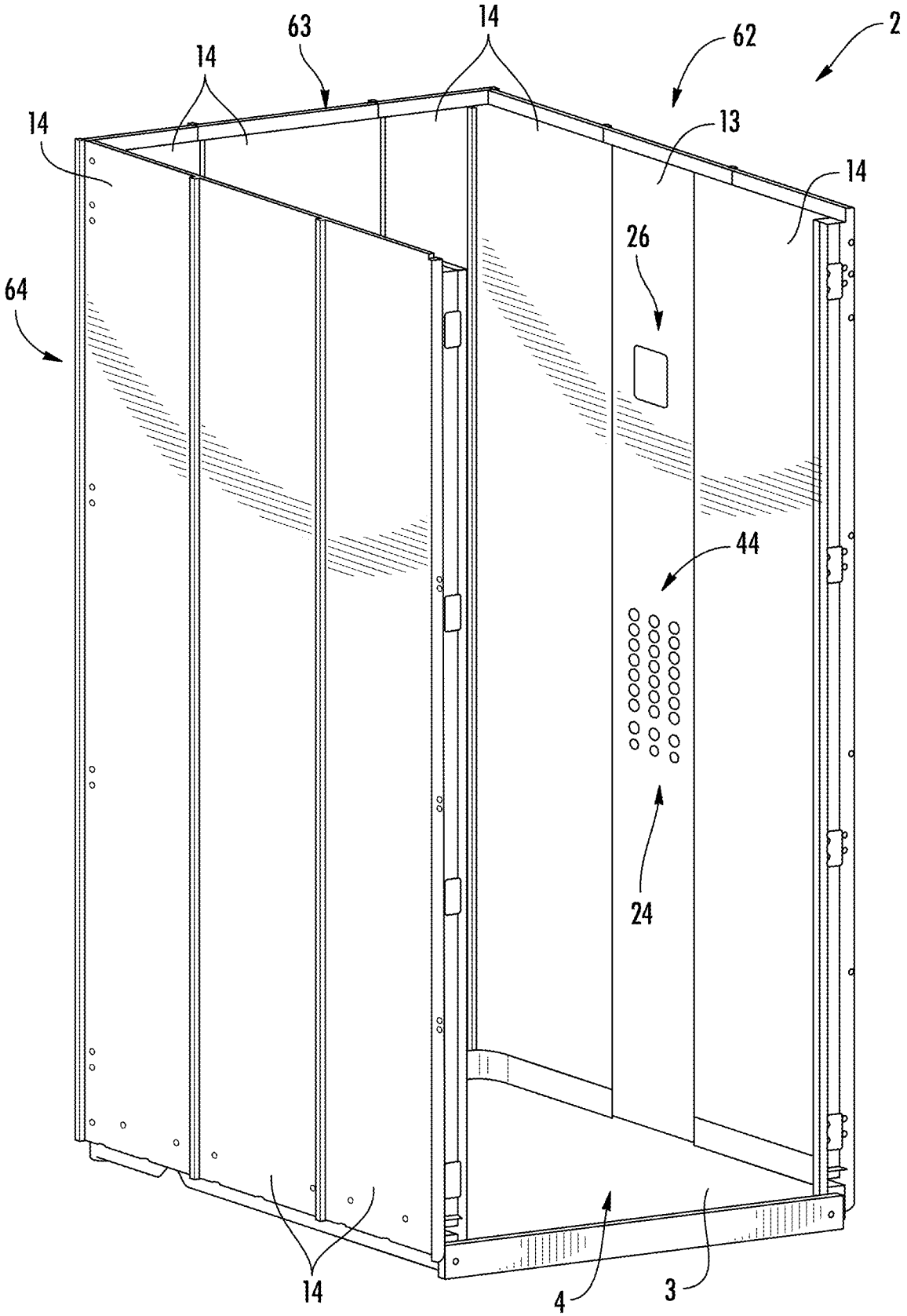
FIG. 1 shows a perspective view of an elevator car according to an exemplary embodiment of the invention.

FIG. 1 shows a perspective view of an elevator car 2 according to an exemplary embodiment of the invention.

The elevator car 2 comprises a basically horizontal bottom plate 3 and three sidewalls 62, 63, 64 extending vertically upwards from the bottom plate 3 defining a prismatic interior space 4 forming the passenger compartment.

The top plate/ceiling of the elevator car 2 and the front sidewall of the elevator car 2 comprising the car door(s) are not shown in FIG. 1 in order to allow an unobstructed view into the elevator car's 2 interior space 4.

Each of the sidewalls 62, 63, 64 is respectively formed by three structural side panels 13, 14 arranged next to each other. Of course, the number of three side panels 13, 14 is only exemplary and the skilled person easily understands that an arbitrary number of side panels 13, 14 may be used for forming the sidewalls 62, 63, 64.

One side panel 13 is provided with a control panel 24 comprising a plurality of push buttons 44 for controlling the elevator and a display 26 allowing to provide information concerning the elevator's status, in particular the number of the floor in which the elevator car 2 is currently located, for the passengers which are present within the elevator car 2.

Figure 2:
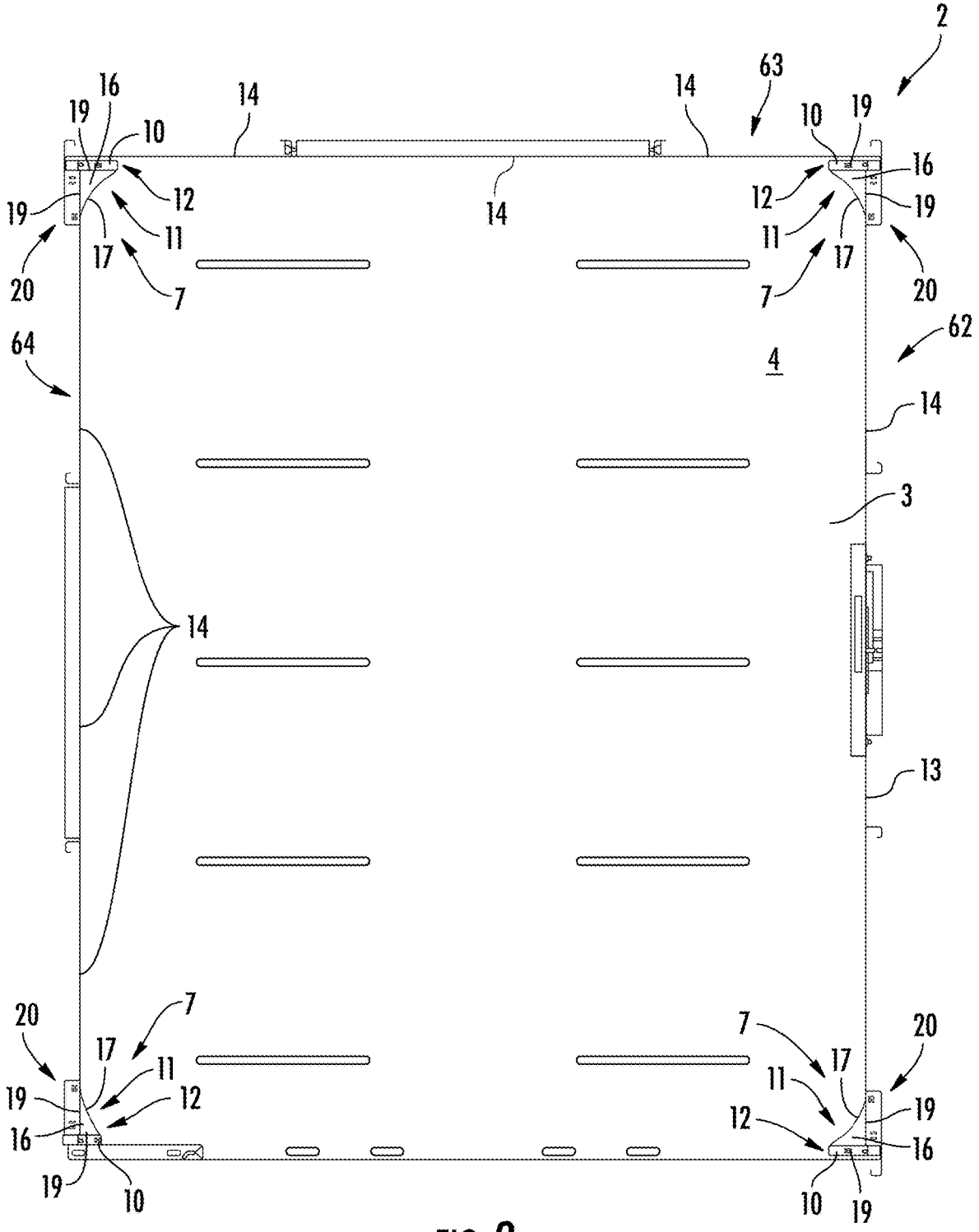
FIG. 2 is a top view of the elevator car shown in FIG. 1.
Figure 3:
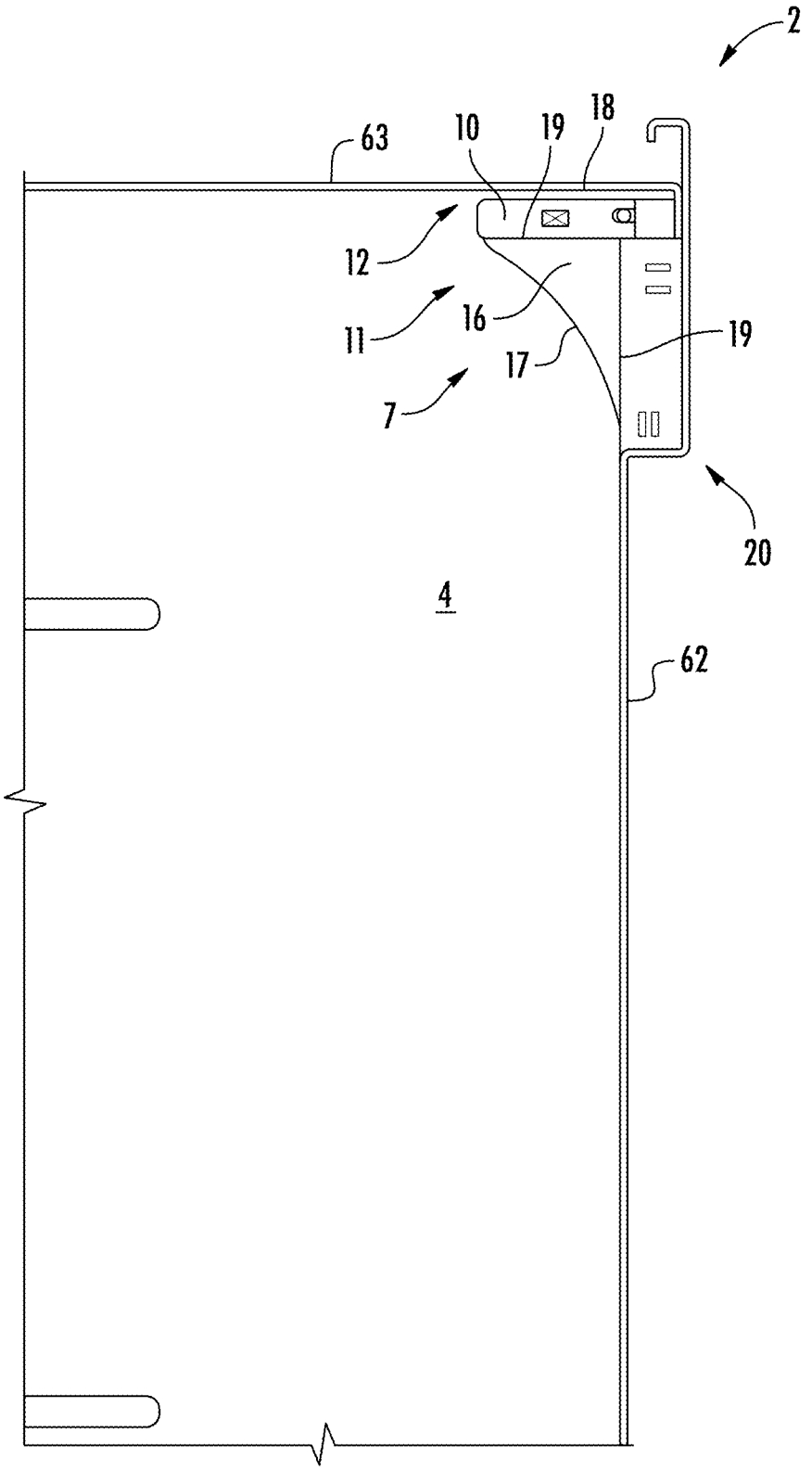
FIG. 3 shows an enlarged view of a vertical extending corner of the elevator car shown in FIGS. 1 and 2.

FIG. 2 is a top view of the elevator car 2 shown in FIG. 1 in particular illustrating the structure of the elevator car's 2 four corners 7; again, the top plate/ceiling of the elevator car 2 and the front sidewall of the elevator car 2 comprising the car door(s) are not shown. FIG. 3 shows an enlarged view of the elevator car's 2 corner 7 which is depicted in the upper right of FIG. 2.

Decorative elements 16 located at each of the elevator car's 2 corners 7 respectively comprise two straight outer walls 19 extending basically orthogonally with respect to each other and parallel to one of the sidewalls 62, 63, 64 forming the respective corner 7, and an arcuate inner wall 17 facing the interior space 4.

At least one of the outer walls 19 is arranged in a distance from the respective opposing sidewall 62, 63, 64 providing an empty space 12 between said outer wall 19 and the associated sidewall 62, 63, 64. Said empty space 12 is configured for accommodating a lighting element 10 for illuminating the interior space 4.

The lighting element 10 together with the decorative element 16 form a lighting arrangement 11 configured to provide indirect illumination of the elevator car's 2 interior space 4. In addition, the lighting arrangement 11 is arranged in such a manner that a ventilation channel providing a ventilation system 18 for ventilating the interior space 4 is associated with the lighting arrangement 11.

The lighting arrangement 11 is arranged such that the lighting element 10 is located in a gap formed between a decorative element 16 and a respective outer sidewall 62, 63, 64 of the elevator car 2. Such a lighting arrangement 11 allows an efficient and appealing illumination of the elevator car's 2 interior space 4 in the way of indirect illumination.

The ventilation system associated with the lighting arrangement 11 comprises a vertically extending ventilation channel providing a ventilation system 18 located in a gap formed between the decorative element 16 with the lighting element 10 mounted to the sidewall 62, 63, 64 of the elevator car 2 and the opposing sidewall 62, 63, 64 of the elevator car 2.

The ventilation channel providing a ventilation system 18 allows to ventilate the elevator car's 2 interior space 4 in particular in situations in which all doors of the elevator car 2 are closed for a long period of time, e.g. when the elevator car 2 is trapped between adjacent floors and the elevator car's 2 car door cannot be opened.

Figure 4:
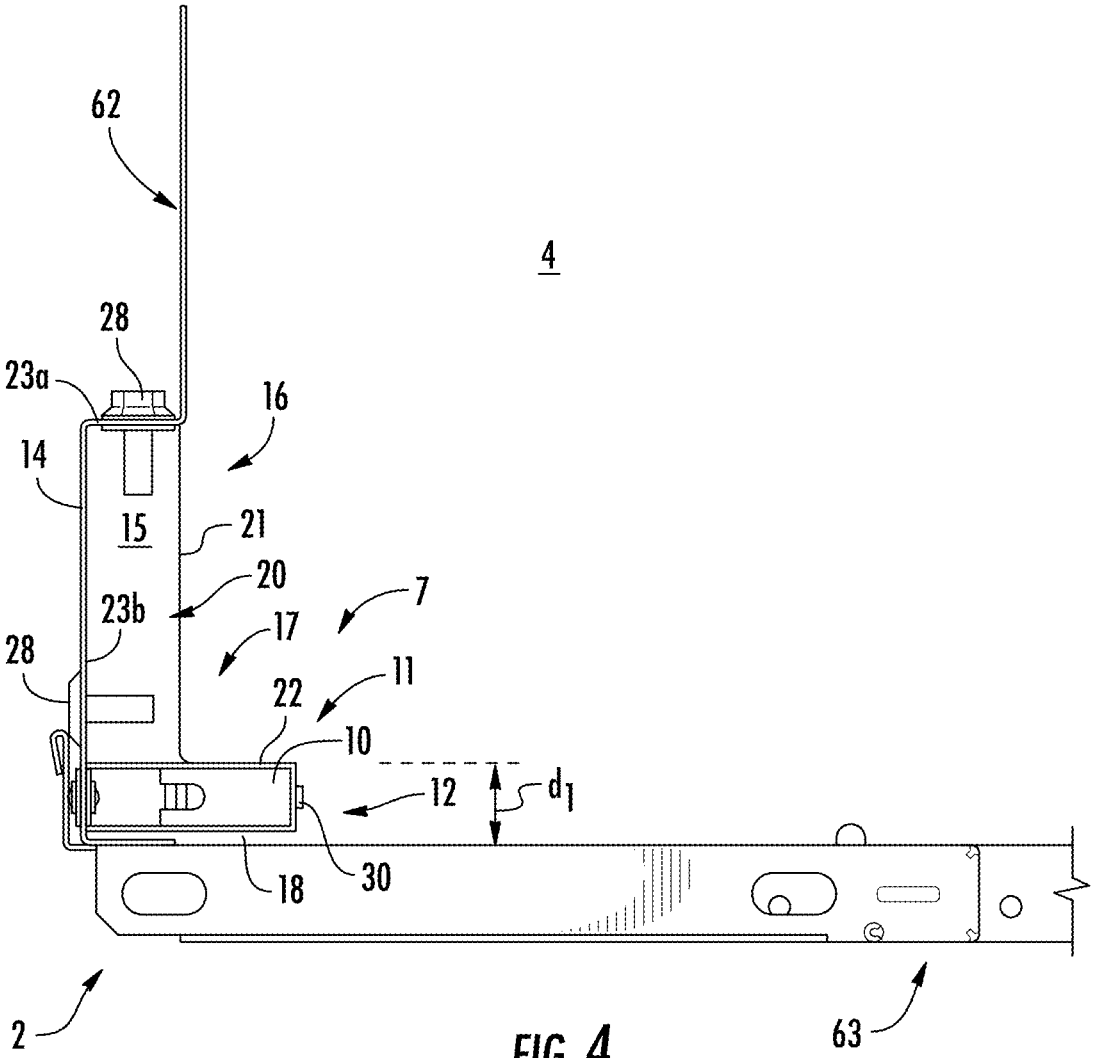
FIG. 4 shows an enlarged view of a vertical extending corner of an elevator car according to an alternative embodiment.

FIG. 4 shows an enlarged view of a vertical extending corner 7 of an elevator car 2 according to an alternative embodiment.

Similar to the embodiments shown in FIGS. 2 and 3, in the embodiment shown in FIG. 4 the structural side panel 14 forming a first outer sidewall 62 is folded to the outside of the elevator car 2 providing a mounting portion 15 for accommodating decorative element 16. The mounting portion 15 forms a recess having a basically rectangular cross section in the view from above, as shown in FIG. 4. The decorative element 16 has the configuration of a decorative column which is formed by a folded sheet, e.g. a metal sheet, providing an inner wall 17 comprising a first portion 21 extending basically parallel to the first sidewall 62 and a double-layered second portion 22 extending basically orthogonally to the first portion 21, i. e. basically parallel to a second sidewall 63 of the elevator car's 2 corner 7.

Folded end portions 23*a*, 23*b* of the sheet forming the decorative element 16 extend basically parallel to corresponding portions of the structural side panel 14 and are respectively fixed to said structural side panel 14 by means of bolts or screws 28. Instead or additionally an adhesive may be used for fixing the decorative element 16 to the structural side panel 14.

The second portion 22 of the decorative element 16 is formed in a distance d1 spaced apart from the adjacent second sidewall 63 extending parallel thereto providing an empty space 12 for accommodating a lighting element 10 which is attached to the second portion 22 of the metal sheet. Even with the lighting element 10 mounted to the decorative element 16 to form the lighting arrangement 11, an additional gap for providing a ventilation channel extending in a vertical direction, with the ventilation channel of the ventilation system 18 being located in the gap defined by the lighting element 10 and the opposite second sidewall 63.

The lighting element 10 comprises at least one LED 30, in particular a plurality of LEDs 30, which are arranged next to each other in the vertical direction. The lighting element 10 in particular comprises at least one LED strip attached to a vertically extending mounting structure.

Figure 5:
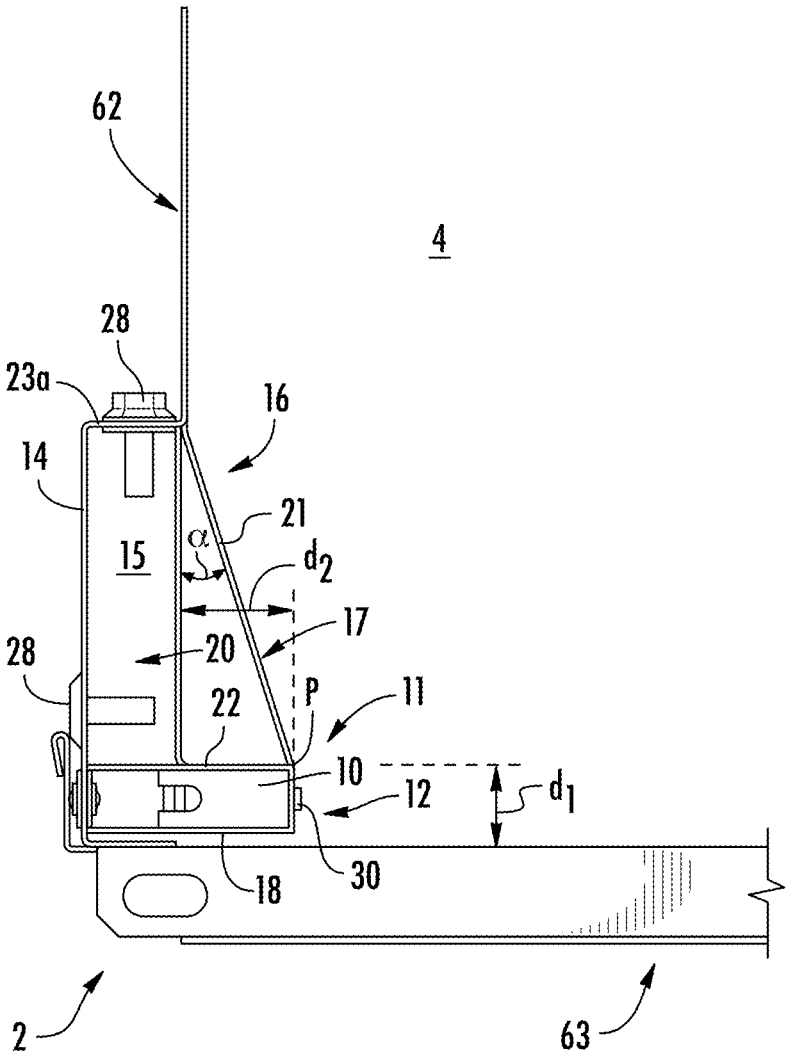
FIG. 5 shows an enlarged view of a vertical extending corner of an elevator car according to yet another embodiment.

FIG. 5 shows a further embodiment, which is similar to the embodiments shown in FIGS. 2, 3, and 4. However, in the embodiment shown in FIG. 5 the first portion 21 of the inner wall 17 formed by the decorative element 16 is not arranged parallel to the first sidewall 62, but in an inclined orientation with an inclination angle $\alpha$ between 0° and 90°, in particular between 0° and 45°, with respect to the elevator car's 2 first sidewall 62.

In consequence, the first portion 21 of the inner wall 17 extends to a position P within the interior space 4 of the elevator car 2, which is spaced apart by a first distance d1 from the second sidewall 63, and which is spaced apart by a second distance d2 from the first sidewall 62. The second portion 22 of the inner wall 17 extends from position P parallel to the second sidewall 63 towards the first sidewall 62.

Providing a distance d1 between the second sidewall 63 and the second portion 22 of the inner wall 17 generates an empty space 12 which allows accommodating a lighting element 10 and a ventilation channel being part of a ventilation system 18 respectively providing the same functionality as it has been described before with respect to FIG. 4.

Figure 6:
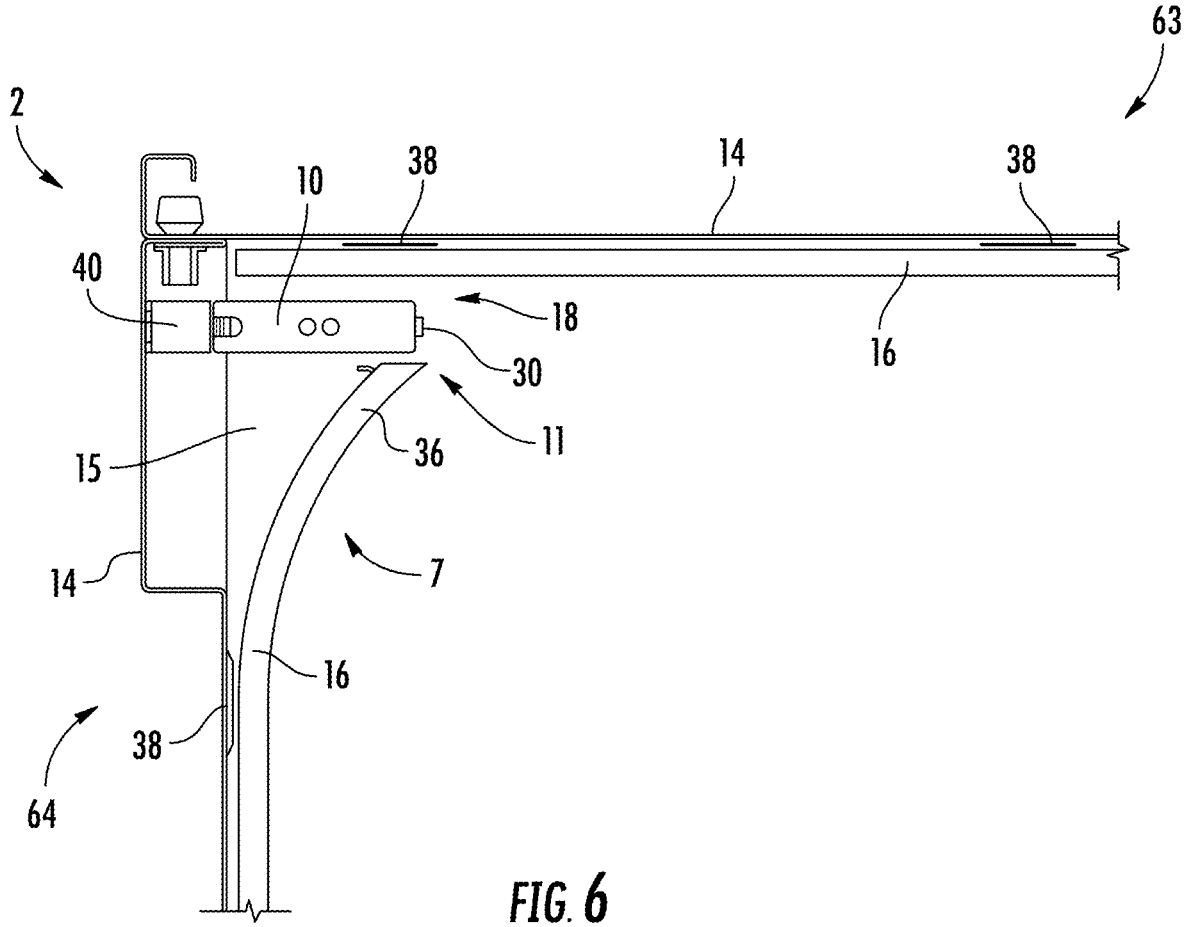
FIG. 6 shows an enlarged view of a vertical extending corner of an elevator car according to a further embodiment.

FIG. 6 illustrates yet another embodiment, in which decorative elements 16, which in particular may be formed from laminated panels, are attached to the structural panels 14 forming the sidewalls 63, 64. The decorative elements 16 may be attached to the structural panels 14 either by means of an adhesive or by means of hook and loop fasteners 38 sandwiched between the respective decorative element 16 and the opposing structural panel 14. Such hook and loop fasteners 38 allow a fast and easy installation and deinstallation of the decorative elements 16.

Similar to the embodiment shown in FIG. 5, a portion of the structural panel 14 is folded to the outside providing a mounting portion 15 for accommodating a lighting arrangement 11. The mounting portion 15 forms a recess having a basically rectangular cross section.

Additionally, a vertical end portion 36 of at least one of the decorative elements 16, which is positioned at one of the corners 7 of the elevator car 2, is bent into an arcuate state in which the edge of said decorative elements 16 is not attached to but spaced apart from the elevator car's 2 first sidewall 62. This enlarges the space provided by the mounting portion 15 between the structural panel 14 forming the first sidewall 62 and the end portion 36 of the decorative elements 16. A lighting element 10, which is attached to the structural panel 14 by means of a clamp or clip 40 and which comprises at least one LED 30, is accommodated within a space of the mounting portion 15 to form a lighting arrangement 11 providing indirect illumination.

The end portion 36 of the decorative element 16 in particular may be bent into a configuration in which the edge of the decorative element 16 basically flushes with the LEDs 30 of the lighting element 10 providing an almost smooth interface between the decorative element 16 and the lighting element 10 in order to avoid any sharp corners or obstacles within the elevator car's 2 interior space 4.

As in the previously discussed embodiments, the lighting arrangement 11 is arranged in some distance from the second sidewall 63 providing a gap therebetween, in which a vertically extending ventilation channel is formed. Such a ventilation channel formed between the lighting arrangement 11 and said second sidewall 63 provides a ventilation system 18 which allows ventilating the elevator car's 2 interior space 4, as it has been discussed before.

In all embodiments at least one opening, which is not visible in the figures, may be provided for connecting the ventilation channel of the ventilation system 18 with the surroundings of the elevator car 2 in order to allow an exchange of air between the elevator car's 2 exterior and interior.

Such an opening in particular may be provided within at least one of the sidewalls 62, 63, 64 within the bottom plate 3 and/or within the top plate (not shown) of the elevator car 2 in order to allow an exchange of air between the interior space 4 of the elevator car 2 and the hoistway (not shown) in which the elevator car 2 is running.

Figure 7:
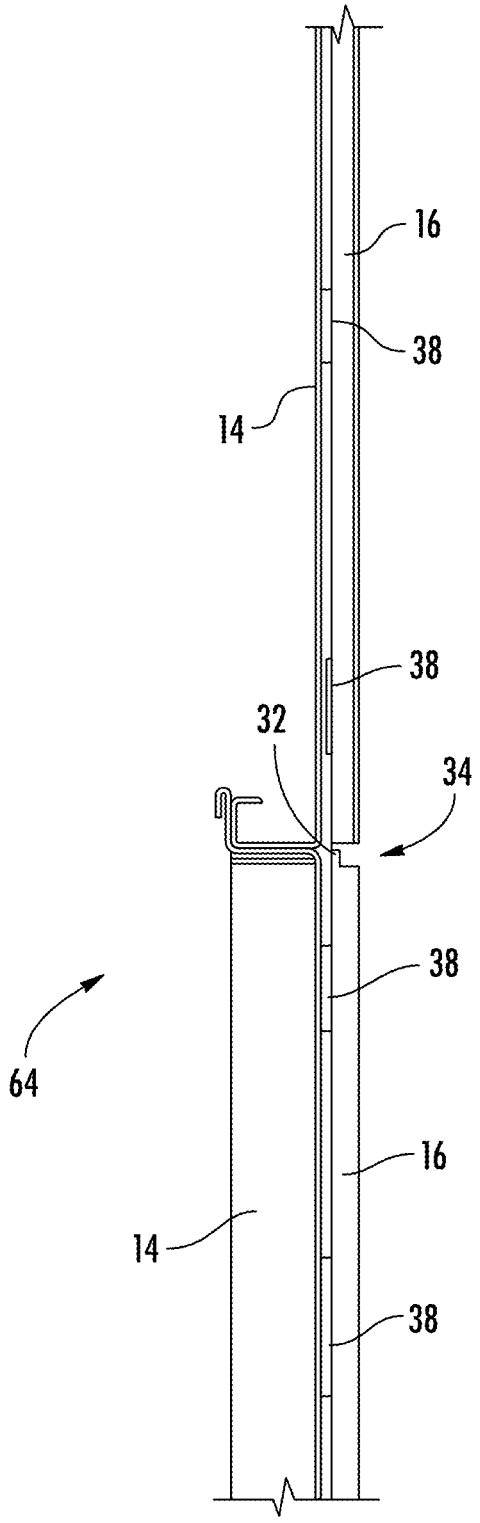
FIG. 7 shows a cross-sectional view of two decorative elements arranged next to each other on a sidewall of an elevator car.

FIG. 7 shows a cross-sectional view of two decorative elements 16, e.g. laminated panels, which are arranged next to each other on a structural panel 14 forming a sidewall 64 of an elevator car 2. In order to facilitate a proper installation of the decorative elements 16, the edge of at least one of the decorative elements 16 facing an adjacent decorative element 16 is provided with a protrusion 32 of e.g. approximately 1 mm. Said protrusion 32 causes a gap 34 being formed between adjacent decorative panels 14 when one of the adjacent decorative panels 14 is installed abutting the protrusion 32 of an adjacent panel 14, as shown in FIG. 7. Said gap 34 allows compensating for tolerances of the dimensions and positions of the decorative panels 14 providing a neat attire of the elevator car's 2 interior space 4 despite these tolerances which are usually unavoidable.

The applicant considers the application of decorative panels using hook and loop fasteners 38 according to FIGS. 6 and 7, and in particular the configuration of abutting adjacent panels 14 by way of a protrusion 32, as shown in FIG. 7, to provide a novel and inventive contribution to the art per se. Therefore, the applicant reserves the right to claim such configuration independent of the other features disclosed herein, particularly independent of the lighting arrangement 11 and/or the ventilation system 18.

Figure 8:
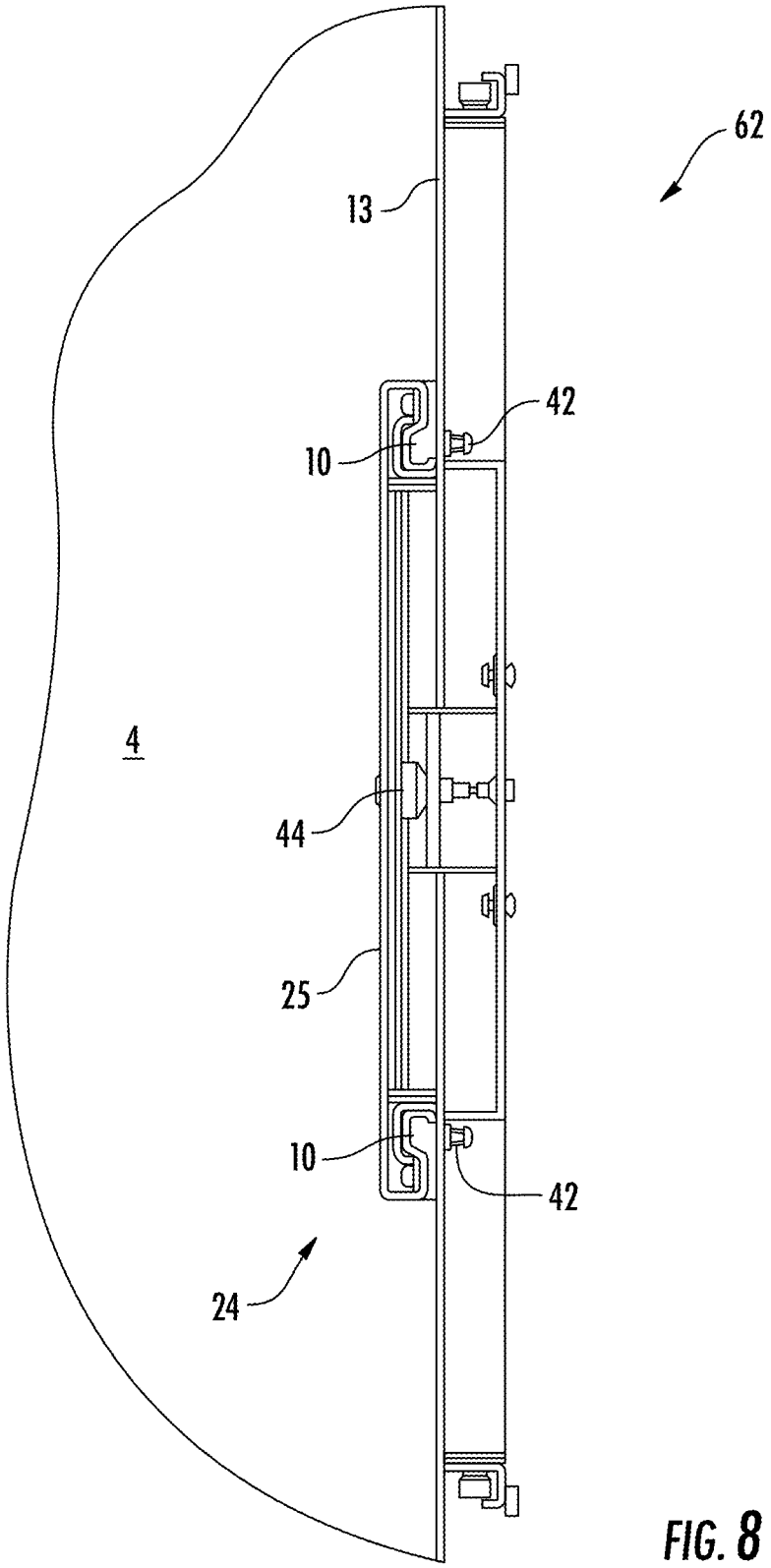
FIG. 8 shows an enlarged view of a structural panel comprising a control panel.

FIG. 8 shows an enlarged view of the structural side panel 13 comprising a control panel 24 comprising a plurality of push buttons 44 provided at the elevator car's 2 first sidewall 62 as shown on the right side of FIG. 2.

The control panel 24 comprises a front panel 25 which is fixed to the structural side panel 13 by means of a couple of fixation elements 42, e.g. bolts or screws. The front panel 25 has shape providing a space on each side of the front panel 25 for respectively receiving a vertically extending lighting element 10 sandwiched between the front panel 25 and the structural side panel 13 allowing additional illumination of the elevator car's 2 interior space 4.

Optional Features:

A number of optional features are set out in the following. These features may be realized in particular embodiments, alone or in combination with any of the other features.

In an embodiment the sidewalls form at least one vertically extending corner and the at least one lighting arrangement is assigned to the at least one vertically extending corner in a position providing indirect illumination of the interior space along the vertically extending corner. Such a configuration allows a very effective illumination of the elevator car's interior space reducing the electrical power needed for operating said illumination without blinding passengers present in the elevator car.

In an embodiment the lighting arrangement includes at least one lighting element extending in vertical direction. This contributes to increasing the efficiency of the illumination and facilitates its installation.

In an embodiment the ventilation system includes a ventilation channel extending between the lighting element and an associated sidewall of the passenger compartment. Such a configuration provides an effective ventilation of the elevator car's interior space without reducing the usable space within the elevator car considerably.

In an embodiment the ventilation system comprises a ventilation opening in the ventilation channel, in particular at the top and/or at the bottom of said ventilation channel, said ventilation opening connecting the ventilation channel with a hoistway in which the elevator car travels in order to allow an exchange of air between the interior of the elevator car and its environment, in particular the hoistway, via the ventilation channel.

In one embodiment at least one edge of the decorative element comprises a protrusion facing an adjacent decorative element for providing a gap between adjacent decorative elements in order to facilitate the installation of a plurality of decorative elements next to each other.

In an embodiment the lighting element comprises at least one LED, in particular a plurality of LEDs arranged next to each other in the vertical direction. LEDs provide reliable light sources which are cheap in production, operation and maintenance and which produce less heat than other light sources.

In one embodiment the plurality of LEDs are provided in the form of at least one LED strip which may be attached to a vertically extending mounting structure, e.g. the decorative element. Providing the LEDs in the form of an LED strip allows an easy and fast installation of the LEDs and facilitates the electrical wiring.

In one embodiment the elevator car comprises at least one structural side panel which is formed providing a mounting portion for supporting at least a portion of the lighting arrangement. Providing a mounting space which is configured for supporting at least a portion of the lighting arrangement facilitates the installation of the lighting arrangement and minimizes the reduction of passenger/load space caused by the installation of the lighting arrangement.

In one embodiment the structural side panel is formed with a recess in a region assigned to the vertically extending corner, said recess providing a mounting portion for the lighting arrangement and/or for the decorative element.

In one embodiment the lighting arrangement comprises a decorative element, wherein at least a portion of the decorative element is attached to the mounting portion and the at least one lighting element is fixed to the decorative element which allows to fix the lighting arrangement efficiently.

In one embodiment the decorative element has an inner wall facing the interior space and at least a portion of said inner wall is oriented basically parallel to the structural panel and/or sidewall providing a maximized interior space having a shape which is similar to the exterior shape of the elevator car.

In one embodiment the decorative element has an inner wall facing the interior space, wherein at least a portion of said inner wall is oriented basically perpendicular to the structural panel and/or sidewall. Providing a basically perpendicular corner in the decorative element allows enhancing the rigidity of said decorative element.

In one embodiment the decorative element has an inner wall facing the interior space, wherein at least a portion of said inner wall is arranged at an angle between 0 and 90 degrees with respect to the structural panel and/or sidewall, particularly at an angle of about 45 degrees, which allows to increase the decorative element's rigidity without considerably reducing the space which is available for accommodating passengers and/or load and which reduces the risk of passengers being hurt when contacting the decorative element.

In one embodiment the decorative element has an inner wall facing the interior space, wherein at least a portion of said inner wall has an arcuate shape which allows to increase the decorative element's rigidity without considerably reducing the space, which is available for accommodating passengers and/or load, and which reduces the risk of passengers being hurt when contacting the decorative element.

In one embodiment the decorative element comprises any of a metal sheet, a metal-plastics composite panel, or a veneer.

In one embodiment the decorative element comprises a metal sheet, wherein at least a portion of the metal sheet is folded, in particular forming at least a portion of the decorative element from a double layer of the metal sheet having a high stability/rigidity. Folding is an easy method of forming a suitable decorative element from a sheet of metal.

In one embodiment the decorative element is attached to the structural panel forming a sidewall of the passenger compartment by means of at least one hook and loop fastener. Hook and loop fasteners allow an easy and cheap installation and de-installation, if necessary, of the decorative elements.

In one embodiment the elevator car further comprises a control panel and at least one lighting element associated with said control panel for additionally illuminating the elevator car's interior space. The control panel in particular may comprise a front panel attached to one of the structural side panels in a configuration providing a space for housing the at least one lighting element.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the dependent claims.

REFERENCES

2 elevator car
3 bottom plate
4 interior space
7 vertically extending corner
10 lighting element
11 lighting arrangement
12 empty space
13, 14 structural side panel
15 mounting space
16 decorative element
17 inner wall
18 ventilation system
19 outer wall
20 recess
21 first portion of the decorative element
22 second portion of the decorative element
24 control panel
25 front plate of the control panel
26 display
28 bold/screw
30 LED
32 protrusion
34 gap
36 end portion of the decorative element
38 hook and loop fastener
40 clamp/clip
42 fixation element
44 push button
62, 63, 64 sidewalls of the elevator car

The invention claimed is:

1. An elevator car comprising:

a passenger compartment defining an interior space surrounded by vertical sidewalls and at least one car door; and at least one lighting arrangement configured for illuminating the interior space, said lighting arrangement co-located with a ventilation system which is configured for ventilating the interior space even in a situation where the car door is closed;

wherein the at least one lighting arrangement comprises a vertically-extending decorative element being one of (i) mounted to a first sidewall of the sidewalls of the elevator car and (ii) formed by the first sidewall of the sidewalls of the elevator car;

wherein the lighting arrangement comprises a gap between the decorative element and a second sidewall of the sidewalls adjacent to the first sidewall of the car, the second sidewall orthogonal to the first sidewall, the gap accommodating the lighting element such as to provide indirect illumination of the interior space.

2. The elevator car of claim 1, wherein the sidewalls form at least one vertically extending corner and the at least one lighting arrangement is assigned to the at least one vertically extending corner in a position in which it provides indirect illumination of the interior space along the vertically extending corner.

3. The elevator car according to claim 1, wherein the lighting arrangement includes at least one lighting element extending in vertical direction.

4. The elevator car according claim 3, wherein the lighting element comprises at least one LED, in particular a plurality of LEDs arranged next to each other in the vertical direction.

5. The elevator car according to claim 4, wherein the lighting element comprises at least one LED strip attached to a vertically extending mounting structure.

6. The elevator car according to claim 1, wherein the ventilation system includes a ventilation channel extending between the lighting arrangement and an associated sidewall of the passenger compartment.

7. The elevator car according to claim 6, wherein the ventilation system comprises a ventilation opening in the ventilation channel, particularly at the top and/or at the bottom of said ventilation channel.

8. The elevator car according to claim 1, wherein the elevator car comprises at least one structural side panel which is formed such as to provide a mounting portion for supporting the at least one lighting arrangement.

9. The elevator car according to claim 8, wherein at least a portion of the decorative element is attached to the mounting portion and the at least one lighting element is fixed to the decorative element and/or to the at least one structural side panel.

10. The elevator car according to claim 8, wherein the structural side panel is formed with a recess in a region assigned to the vertically extending corner, said recess forming the mounting portion for the lighting element and/or the decorative element.

11. The elevator car according to claim 8, wherein the decorative element has an inner wall facing the interior space and at least a portion of said inner wall is oriented parallel to the structural side panel.

12. The elevator car according to claim 8, wherein the decorative element has an inner wall facing the interior space and wherein at least a portion of said inner wall is arranged at an angle between 0 and 90 degrees with respect to the structural side panel, in particular at an angle of about 45 degrees.

13. The elevator car according to claim 8, wherein the decorative element comprises at least one decorative panel attached to the sidewall of the structural side panel facing the interior space.

14. The elevator car according to claim 13, wherein the decorative panel is attached to the sidewall of the structural panel by means of at least one hook and loop fastener.

15. The elevator car according to claim 1, wherein at least one edge of the decorative element comprises a protrusion facing an adjacent decorative element and providing a gap between adjacent decorative elements.

16. The elevator car according to claim 1, wherein the decorative element has an inner wall facing the interior space and wherein at least a portion of said inner wall is arcuate.

17. The elevator car according to claim 1, wherein the decorative element comprises a metal sheet, in particular at least a portion of the metal sheet being folded such as to form at least a portion of the decorative element by a double layer of the metal sheet.

18. The elevator car according to claim 1, further comprising a control panel attached to one of the sidewalls of the elevator car.

19. An elevator car comprising:

a passenger compartment defining an interior space surrounded by vertical sidewalls and at least one car door; and at least one lighting arrangement configured for illuminating the interior space, said lighting arrangement co-located with a ventilation system which is configured for ventilating the interior space even in a situation where the car door is closed;

wherein the at least one lighting arrangement comprises a vertically-extending decorative element being one of (i) mounted to a first sidewall of the sidewalls of the elevator car and (ii) formed by the first sidewall of the sidewalls of the elevator car;

wherein the lighting arrangement comprises a gap between the decorative element and a second sidewall of the sidewalls adjacent to the first sidewall of the car, the second sidewall orthogonal to the first sidewall, the gap accommodating the lighting element such as to provide indirect illumination of the interior space;

the ventilation system comprising a vertically extending ventilation channel located in the gap formed between the decorative element and the second sidewall.

* * * * *